US007123233B2

(12) United States Patent
Senda

(10) Patent No.: US 7,123,233 B2
(45) Date of Patent: Oct. 17, 2006

(54) DISPLAY DEVICE

(75) Inventor: Michiru Senda, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 464 days.

(21) Appl. No.: 10/120,150

(22) Filed: Apr. 11, 2002

(65) Prior Publication Data

US 2002/0163492 A1 Nov. 7, 2002

(30) Foreign Application Priority Data

Apr. 11, 2001 (JP) ..... 2001-112726
Mar. 11, 2002 (JP) ..... 2002-065643

(51) Int. Cl.
*G09G 3/36* (2006.01)

(52) U.S. Cl. ..... 345/98; 341/153

(58) Field of Classification Search ..... 345/690, 345/692, 214, 98, 204, 90, 92, 89, 94, 87, 345/100, 205; 341/150, 144, 153, 135; 257/72
See application file for complete search history.

(56) References Cited

U.S. PATENT DOCUMENTS 5,052,777 A * 10/1991 Ninnis et al. ..... 385/19
5,170,158 A * 12/1992 Shinya ..... 345/98
5,448,258 A 9/1995 Edwards
5,712,652 A 1/1998 Sato et al.
5,771,031 A * 6/1998 Kinoshita et al. ..... 345/98
5,790,090 A 8/1998 Libsch et al.
5,818,407 A * 10/1998 Hori et al. ..... 345/92
5,945,972 A 8/1999 Okumura et al.
5,952,991 A 9/1999 Akiyama
5,977,940 A 11/1999 Akiyama et al.
6,023,308 A 2/2000 Takemura
6,072,454 A 6/2000 Nakai et al.
6,333,737 B1 12/2001 Nakajima
6,335,778 B1 1/2002 Kubota et al.
6,392,354 B1 * 5/2002 Matsueda ..... 315/169.1
6,424,331 B1 * 7/2002 Ozawa ..... 345/98
2002/0030670 A1 3/2002 Matsueda

FOREIGN PATENT DOCUMENTS

EP 0 797 182 9/1997
EP 1 020 840 7/2000
JP 58-23091 2/1983
JP 6214214 8/1994
JP 7-261155 10/1995
JP 08-194205 7/1996
JP 09-236823 9/1997
JP 10-253941 9/1998
JP 10-253984 * 9/1998
JP 2001-242819 9/2001

* cited by examiner

*Primary Examiner*—Richard Hjerpe
*Assistant Examiner*—Abbas Abdulselam
(74) *Attorney, Agent, or Firm*—Morrison & Foerster LLP

(57) ABSTRACT

In a display device, clock supplying transistors turn on and off in response to a digital image signal retained in capacitance elements fed from drain signal lines through pixel element selection transistors. The image signal is applied to capacitance electrodes through the clock supplying transistors. Voltages change at the pixel element electrodes according to the value of the digital image signal. Therefore, a DA conversion is possible at the pixel element portion, leading to simplification of the peripheral circuit configuration around pixel element portions and the reduction of the framing area of the panel.

14 Claims, 12 Drawing Sheets

<n5 = 0>

DISPLAY DEVICE

BACKGROUND OF THE INVENTION

1. Field of the Invention

This invention relates to a display device, especially to a display device with a DA converter that converts the digital image signal to an analog image signal.

2. Description of the Related Art

There has been a great demand on the market for portable devices with a display such as a portable TV and a portable telephone. All these devices need a small, lightweight and low-power consumption display device, and development efforts have been made accordingly.

FIG. 14 shows a circuit diagram of a display pixel element of a conventional liquid crystal display device (LCD). On an insulating substrate (not shown) a gate signal line 51 is disposed in one direction and a drain signal line 61 is disposed in a direction perpendicular to the gate signal line 51. A pixel element selection thin film transistor 72 connected to both signal lines 51, 61 is formed near the crossing of the signal lines, 51, 61. The thin film transistor will be referred to as the TFT hereinafter. A source 11*s* of the pixel element selection TFT 72 is connected to a display electrode 80 of a liquid crystal 21.

Also, a storage capacitance element 85 for holding the voltage of the display electrode 80 for one field period is formed. One terminal 86 of the storage capacitance element 85 is connected to the source 11 s of the TFT 72, and the other terminal 87 is provided with a voltage commonly used among the pixel elements.

When a scanning signal (H level) is applied to the gate signal line 51, the pixel element selection TFT 72 turns on and an analog image signal is transmitted to the display electrode 80 through the drain signal line 61 and retained in the storage capacitance element 85. The image signal voltage applied to the display electrode 80 is then applied to the liquid crystal 21. Based on the voltage applied, the liquid crystal aligns itself for providing a liquid crystal display image.

The analog image signal applied to the drain signal line 61 is obtained by converting an input digital image signal through a digital to analog conversion by a DA converter. In a conventional liquid crystal display device having a DA converter in a display panel, the DA converter is formed near driver circuits in the peripheral area of pixel elements.

However, since the DA converter is formed near the driver circuits of such a conventional device, the design flexibility of the circuits surrounding the pixel elements is restricted. This also results in a larger framing area of a display panel. Especially, when gradation is required of a display device, the number of terminals for gradation voltages increase in accordance with the depth of the display.

Also, in order to write an analog signal converted by the DA converter into a pixel element portion through the pixel element TFT 72, a voltage higher than a threshold voltage, Vth, should be supplied as the scanning signal. Here, the threshold voltage Vth is the threshold voltage of the pixel element selection TFT 72. Therefore, reducing the applied voltage and the power consumption of the liquid crystal display device is difficult.

SUMMARY OF THE INVENTION

The invention provides a display device including a pixel element portion and a pixel element electrode for receiving an analog image signal, which is disposed in the pixel element portion. The device also has a DA converter converting a digital image signal to the analog image signal, which is disposed in the pixel element portion.

The invention also provides a display device including a gate signal line and a pixel element portion. The device also includes a plurality of pixel element selection transistors each selecting the pixel element portion in response to a scanning signal inputted from the gate signal line. A drain signal line is provided for receiving a digital image signal. A data retaining portion is provided for holding the digital image signal inputted through the pixel element selection transistors. The device includes a pixel element electrode and a plurality of capacitance electrodes each forming capacitance coupling with the pixel element electrode based on respective predetermined weighed capacitance ratios. A clock supplier portion is provided for supplying a cyclical clock signal to the capacitance electrodes in response to the digital image signal retained in the data retaining portion. In this configuration, the selection transistors, the data retaining portion, the pixel element electrode, the capacitance electrodes and the clock supplier portion are disposed in the pixel element.

The invention further provides a display device including a plurality of pixel elements and a plurality of pixel element electrodes disposed in the respective pixel elements. Each of the pixel element electrodes face a plurality of capacitance electrodes electrically insulated from the pixel element electrode and each forming capacitance coupling with the pixel element electrode based on respective predetermined weighed capacitance ratios. In this configuration, a voltage applied to the pixel element electrode is changed by applying a voltage corresponding to a digital image signal to each of the capacitance electrodes corresponding to the pixel element electrode.

The invention also provides a display device including a plurality of pixel elements and a plurality of pixel element electrodes disposed in the respective pixel elements. Each of the pixel element electrodes face a plurality of capacitance electrodes electrically insulated from the pixel element electrode and each forming a capacitance coupling with the pixel element electrode based on respective predetermined weighed capacitance ratios. The device also includes a plurality of clock supplier portions supplying a cyclical clock signal in response to a digital image signal to the capacitance electrodes. The clock supplier portions are disposed in the corresponding pixel elements. The device includes a plurality of clock signal selection portions selecting the clock signal according to a voltage corresponding to the highest bit of the digital image signal. The clock signal selection portions is disposed in the corresponding pixel elements. The device also includes a plurality of reset signal supplier portions selecting a reset signal and supplying the reset signal to the pixel element electrodes according to a voltage corresponding to the highest bit of the digital image signal. The reset signal supplier portions are disposed in the corresponding pixel elements.

In each of the display devices described above, a DA converter is formed within the display device. Therefore, the configuration of peripheral circuits of the pixel element portion is simplified, leading to a reduced framing area of the display panel.

DETAILED DESCRIPTION OF THE INVENTION

Figure 1:
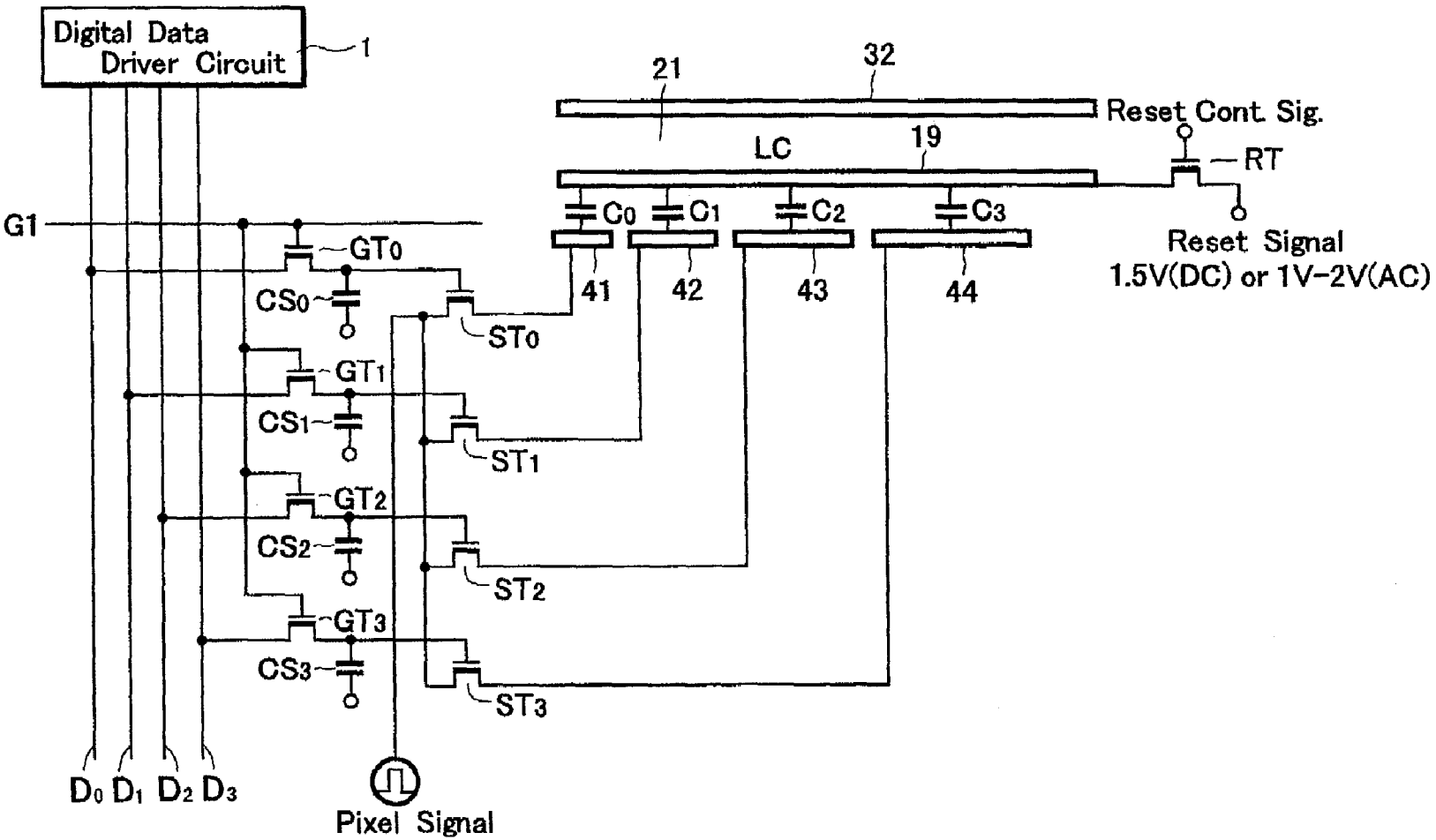
FIG. 1 is a circuit diagram of a liquid crystal display device of a first embodiment of this invention.

A display device of a first embodiment of this invention is now explained. FIG. 1 shows a circuit diagram of the display device of the first embodiment of this invention. In the figure, only one pixel element portion is shown for the sake of simplicity. However, in an actual display device, a plurality of pixel element portions are disposed in a matrix configuration.

On an insulating substrate (not shown), a gate signal line G1 is disposed in one direction. A scanning signal is fed from a gate driver (not shown) to the gate signal line G1. Four drain signal lines D0–D3 are disposed in a direction perpendicular to the gate signal line G1. A digital data driver circuit 1 outputs a 4-bit digital image signal in response to a sampling signal. The signal corresponding to each bit of the digital image signal is outputted to the drain signal lines D0–D3. The lowest level bit (the lowest significant bit) is outputted to the drain signal line D0, and the highest level bit (the most significant bit) to the digital signal line D3. By increasing the number of the bits of the digital image signal, a display with a deep depth is possible. On the other hand, if the number of the bits of the digital image signal is decreased, a display with a shallow depth is possible.

Pixel element transistors GT0–GT3 are connected to each of the drain signal lines D0–D3, respectively. Each gate of the pixel element transistors GT0–GT3 is connected to the gate signal line G1. Each source of the pixel elements transistors is respectively connected to each of capacitance elements CS0–CS3 that retain each of the bit signal of the digital image signal written through the pixel element transistors GT0–GT3.

Each of the bit signals retained in the capacitance elements CS0–CS3 is then supplied to the gates of clock supplier transistors ST0–ST3. A pixel signal (cyclical signal) is supplied to the sources of the clock supplier transistors ST0–ST3. And the drains of the clock supplier transistors ST0–ST3 are connected to capacitance electrodes 41, 42, 43, and 44, which make a capacitance coupling with a pixel element electrode 19, independently.

Therefore, between the pixel element electrode 19 and the capacitance electrodes 41, 42, 43, 44, capacitance elements C0, C1, C2, and C3 are formed, respectively. Between the pixel element electrode 19 and a common electrode 32, a liquid crystal 21 is enclosed.

That is, the clock supplier transistors ST0–ST3 turn on and off in response to the digital image signal, which is fed from the drain signal lines D0–D3 through the pixel element transistors GT0–GT3 and is retained in the capacitance elements CS0–CS3. For example, when the clock supplier transistor ST0 turns on, the pixel signal is applied to the capacitance electrode 41 through the clock supplier transistor ST0. Therefore, at the pixel element electrode 19, the voltage change ΔV, corresponding to the voltage amplitude VP-P of the pixel signal and the capacitance value C0 are generated. Note that "C0", which represents the capacitance element C0, is also used to represent the capacitance of the capacitance element C0. C1, C2, C3 also represent, respectively, the capacitance of the capacitance elements.

$$\Delta V = C0 \times VP\text{-}P/(CLC + C0) \quad (1)$$

Here, CLC is a capacitance between the pixel element electrode 19 and the common electrode 32.

Therefore, by assigning weights according to the respective bit levels of the digital image signal to the capacitance elements C0, C1, C2, C3, an analog signal can be generated from the digital signal at each pixel element electrode 19. In other words, these weights, or weighed capacitance ratios, determines each capacitance of the capacitance elements C0–C3.

$$\Delta V = \Sigma C \times VP\text{-}P/(CLC + \Sigma C) \quad (2)$$

$$\Sigma C = n0 \times C0 + n1 \times C1 + n2 \times C2 + n3 \times C3 \quad (3)$$

Here, a set of (n0, n1, n2, n3) denotes a digital image signal, and each bit, n0, n1, n2, n3, is either a "1" or a "0".

Figure 4:
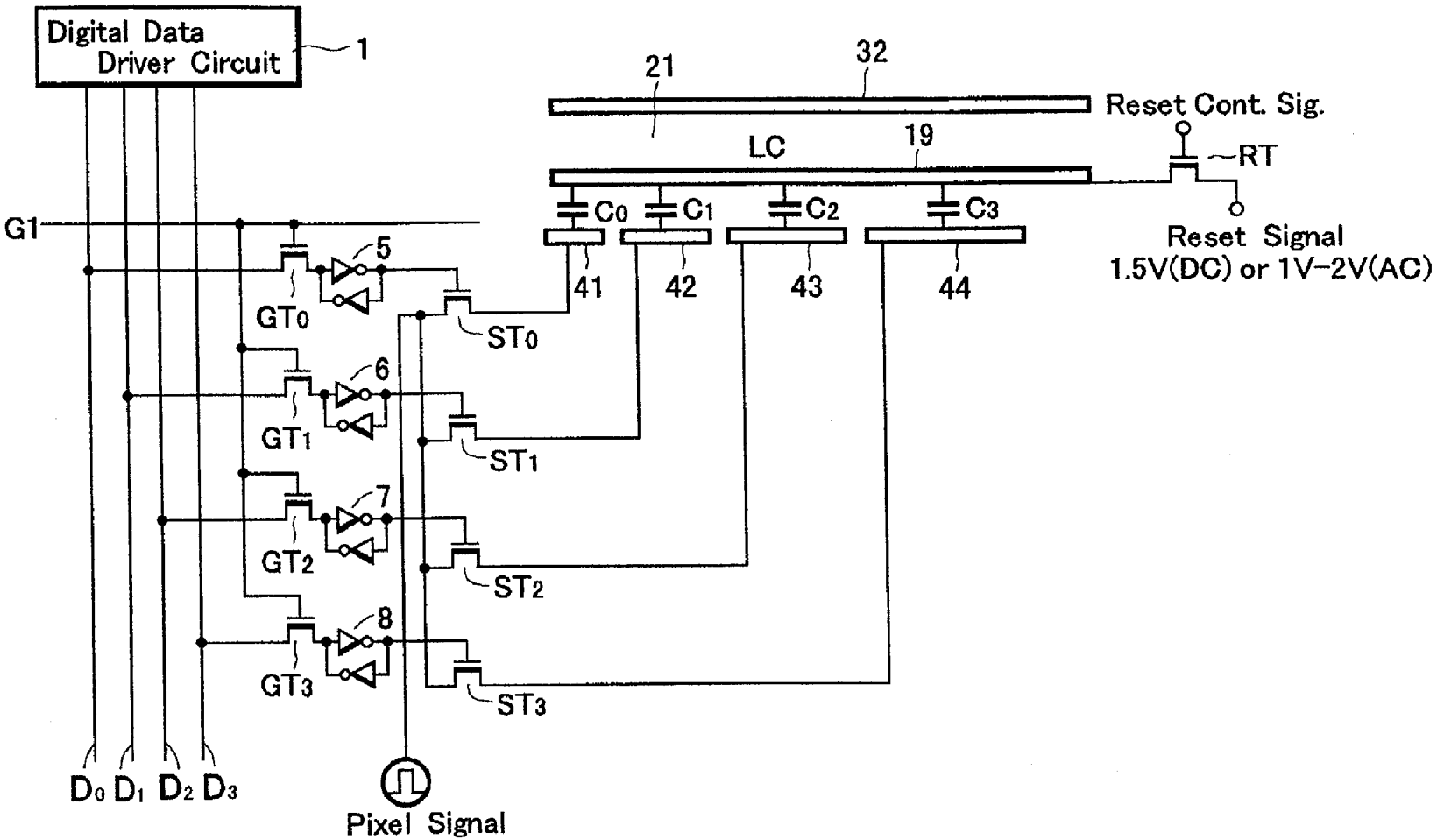
FIG. 4 is a circuit diagram of a liquid crystal display device of a second embodiment of this invention.

In this estimation, capacitance formed between the display electrode and the wiring within the pixel element is omitted. In the configuration of FIG. 4, the capacitance of each capacitance element C0–C3 is determined by adjusting the distance between the capacitance electrode 41–44, or by adjusting the area of the capacitance electrode 41–44. In this embodiment, the weighed capacitance ratios are as follows:

$$C1 = 2\ C0,\ C2 = 2^2\ C0,\ C3 = 2^3\ C0$$

In other words, if the capacitance of the capacitance element C0 is 1, the capacitance of capacitance element C1, C2 and C3 are 2, 4 and 8, respectively.

Also, a reset transistor RT for supplying a reset signal to the pixel element electrode 19 is provided. This enables the display device to operate by the inverting driving method in which inverted voltages are applied alternatively to the liquid crystal 21. This method is useful because applying the electric field from one direction to the liquid crystal 21 may cause deterioration of the liquid crystal. In the inverting driving method, the direction of the electric field applied to the liquid crystal 21 is cyclically inverted to prevent deterioration of the liquid crystal.

Figure 2:
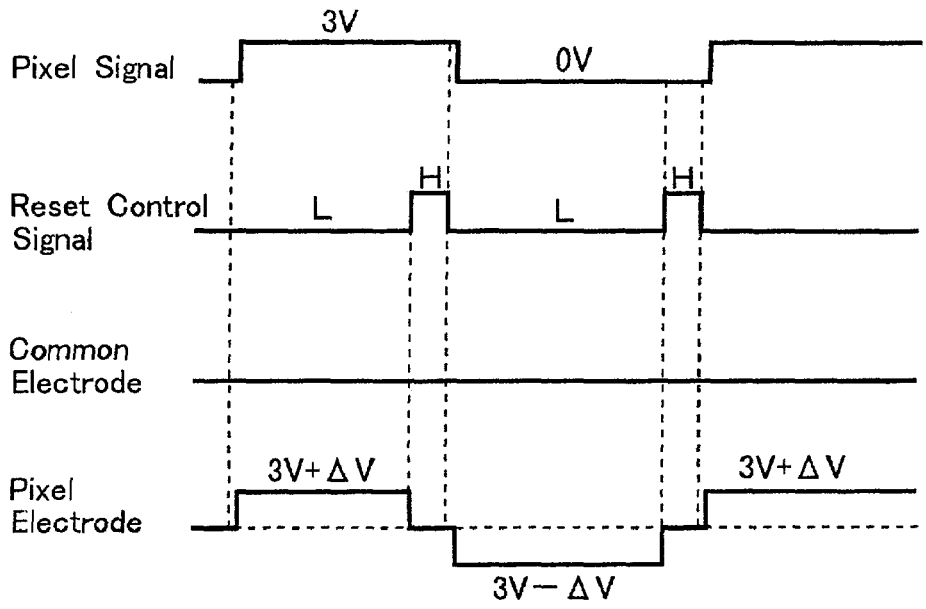
FIG. 2 is the timing chart of the liquid crystal display device of the first embodiment of this invention.

Next, the operation of the liquid crystal display device with the above configuration will be described. FIG. 2 is a timing chart of the liquid crystal display device of the first embodiment. The pixel signal is the signal supplied to the capacitance electrodes 41–44 through the transistors ST0–ST3. The signal repeatedly changes between 0V and 3V with a predetermined cycle. A reset control signal is the signal supplied to the gate of the reset transistor RT. The reset control signal is a pulse signal, which turns to high immediately before the pixel signal is inverted. The common electrode 32 is fixed at a direct current level of, for example, 3V.

Suppose the 4-bit digital image signal of, for example (1, 0, 0, 0,) is supplied to the drain signal lines D0–D3. In response to the scanning signal supplied to the gate signal line G1, the pixel element selection transistors GT0–GT3 turn on. Among the capacitance elements CS0–CS3, the CS0, which receives the signal "1", is charged and the CS1–CS3 are discharged through the pixel element transistors GT0–GT3, retaining the signal (1, 0, 0, 0). Therefore, the clock supplier transistor ST0 turns on and ST1–ST3 turn off, applying the pixel signal to the capacitance electrode 41 through the clock supplier transistor ST0.

When the pixel signal changes from 0V to 3V, the voltage of the pixel element electrode 19 also increases from 3V, which is the same as the voltage of the common electrode 32, by ΔV0 corresponding to the capacitance value of the capacitance electrode 41 and the pixel element electrode 19, because the capacitance electrode 41 and the pixel element electrode 19 form capacitance coupling. Likewise, if the other 4-bit signal is inputted, the transistors ST0–ST3 turn on and off in response to each bit of "1" or "0". Accordingly, the voltage of the pixel element electrode 19 changes to a voltage corresponding to this 4-bit digital image signal, which is retained in the capacitance elements CS0–CS3. If the voltage of the capacitance elements CS0–CS3 becomes lower than the threshold voltage of the transistors ST0–ST3 due to the leakage current of the transistors, the retained signal will be lost. This requires refreshing the signal retained in the capacitor.

In this manner, the signal is retained in a data retaining portion that has the capacitance elements CS0–CS3. Therefore, when a still image is displayed, it is possible to reduce the frame rate to the lowest frequency necessary for refreshing the retained signal by the data retaining portion, leading to the reduction of the power consumption of the display device. Also, unlike the display device of the prior arts in which a DA converter is formed in the peripheral area of the driver, a DA converter is formed within the pixel element by the capacitance coupling, leading to the reduction of the framing area of the display device.

When the reset signal changes to "H", the reset transistor RT turns on and the voltage of the pixel element electrode is reset to 3V, the same voltage as the common electrode 32. When the reset signal returns to "L", the pixel signal changes back from 3V to 0V. Therefore, the voltage of the pixel element electrode 19 decreases by ΔV0 from 3V due to the capacitance coupling. Since the voltage of the pixel element electrode 19 is inverted against the common electrode 32 in this manner, the display device can be operated without deterioration of the liquid crystal 21.

The refreshing cycle (frequency) of the data retaining portion can be independent from the pixel signal cycle. It is not necessarily the same cycle as the pixel signal cycle. The refreshing cycle can be set to the slowest cycle as long as the need for refreshing the signal in the data retaining portion is fulfilled. Also, the inverting cycle of the pixel signal can be set to the slowest cycle, as long as the deterioration of the liquid crystal is prevented. In this manner, the power consumption can further be reduced. However, there is a possibility that noise may appear in the displayed image because of the parasitic capacitance formed between the pixel element electrode 19 and the wiring in the pixel element or the parasitic capacitance among wiring in the pixel element upon the refreshing operation of the retained signal. Therefore, it is preferable to make each cycle as slow as possible and to make the two cycles synchronous.

Figure 3:
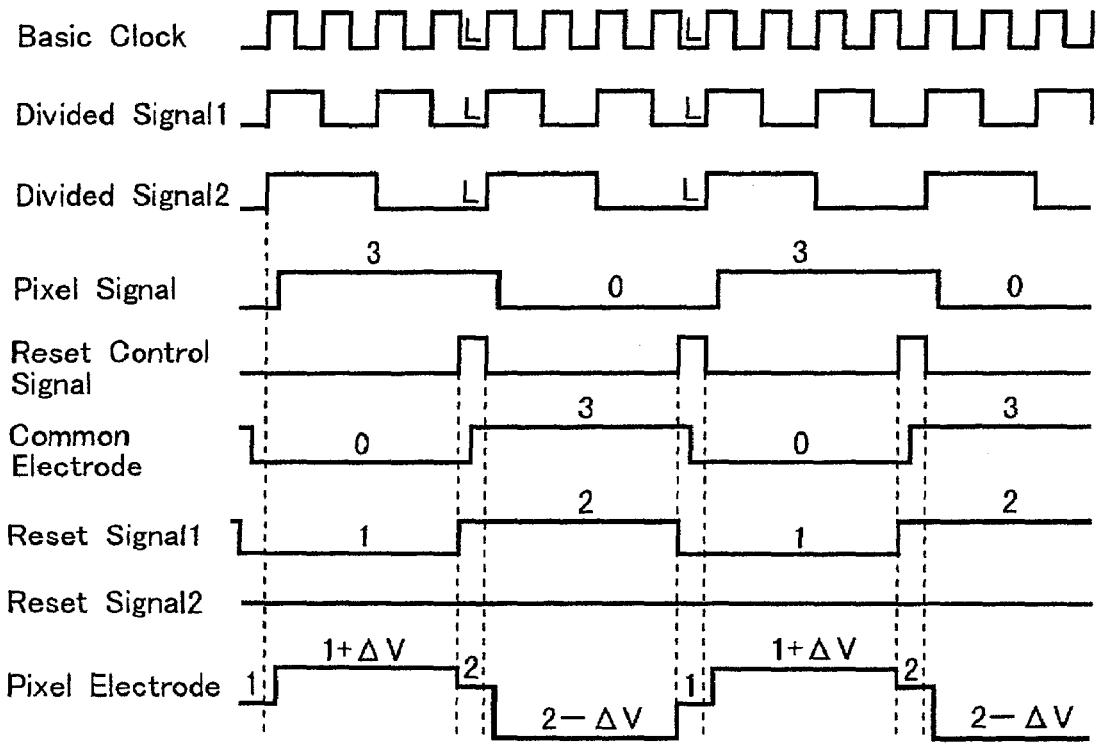
FIG. 3 is another timing chart of the liquid crystal display device of the first embodiment of this invention.

FIG. 3 shows another timing chart of the liquid crystal display device. In this case, the common electrode 32 is driven by an AC voltage. The pixel signal is created by dividing and delaying a standard clock. The pixel signal has two different voltage amplitudes, 0V and 3V The voltage of common electrode 32 and the pixel signal have phases opposite to each other. Also, the reset transistor RT resets the voltage of the pixel element electrode 19 to the signal level of a reset signal 1 or a reset signal 2 based on the reset control signal. In the figure, the reset signal 1 is selected. The reset signal 2 precedes the voltage of common electrode 32 and changes immediately before the reset control signal changes to high or it changes simultaneously with the reset control signal. When the voltage of the common electrode is 0V and when the reset control signal is high, the pixel element electrode 19 is reset to 2V.

When, the reset control signal returns to low, making the pixel signal inverted to 0V, the voltage of the pixel element electrode 19 decreases by ΔV from 2V due to the capacitance coupling between the capacitance electrodes 41–44 and the pixel element electrode 19. As seen from the figure, the pixel element electrode 19 is driven in such a way that its polarity alternates with respect to the common electrode 32.

Next, the display device of the second embodiment of this invention is described. FIG. 4 shows a circuit diagram of a display device of a second embodiment of this invention. In the figure, only one pixel element portion is shown for the sake of simplicity. However, in an actual display device, a plurality of pixel element portions are preferably disposed in a matrix configuration. Also, for the same parts as in the first embodiment of FIG. 1, the same reference numerals will be used, and the explanation thereof will be omitted.

In this embodiment, instead of the capacitance elements CS0–CS3 for holding the signal in the first embodiment, static memory circuits 5–8 are disposed. Each of the static memory circuits 5–8 comprise two inverter circuits, which positively feed back to each other. In the first embodiment, a refreshing operation is required for retaining the signal. However, since the static memory circuit is used in this embodiment, the data retention can be performed more accurately. Also, for the still image display, the signal retained in the data retaining portion can be displayed and the drive of external circuits and driver circuits can be halted, leading to a further reduction of power consumption compared to the first embodiment. However, compared to the first embodiment, this embodiment requires a larger number of devices, increased size, and a more complicated circuit design. Since the operation of the display device is the same as that of the first embodiment, an explanation of the operation will be omitted.

Next, the display device of the third embodiment of this invention is described. As described above, at a pixel element electrode 19, the voltage ΔV corresponding to the digital image signal expressed by the equation (2) is generated in the first and second embodiments. According to the equation (2), the range of this voltage ΔV decreases as the digital image signal increases. Especially, when the number of bits of the digital image signal increases, the range of the voltage ΔV at the high-bit end of the gradation spectrum decreases, leading to deterioration of the γ characteristics. This problem will be further discussed by referring to FIG. 5.

Figure 5:
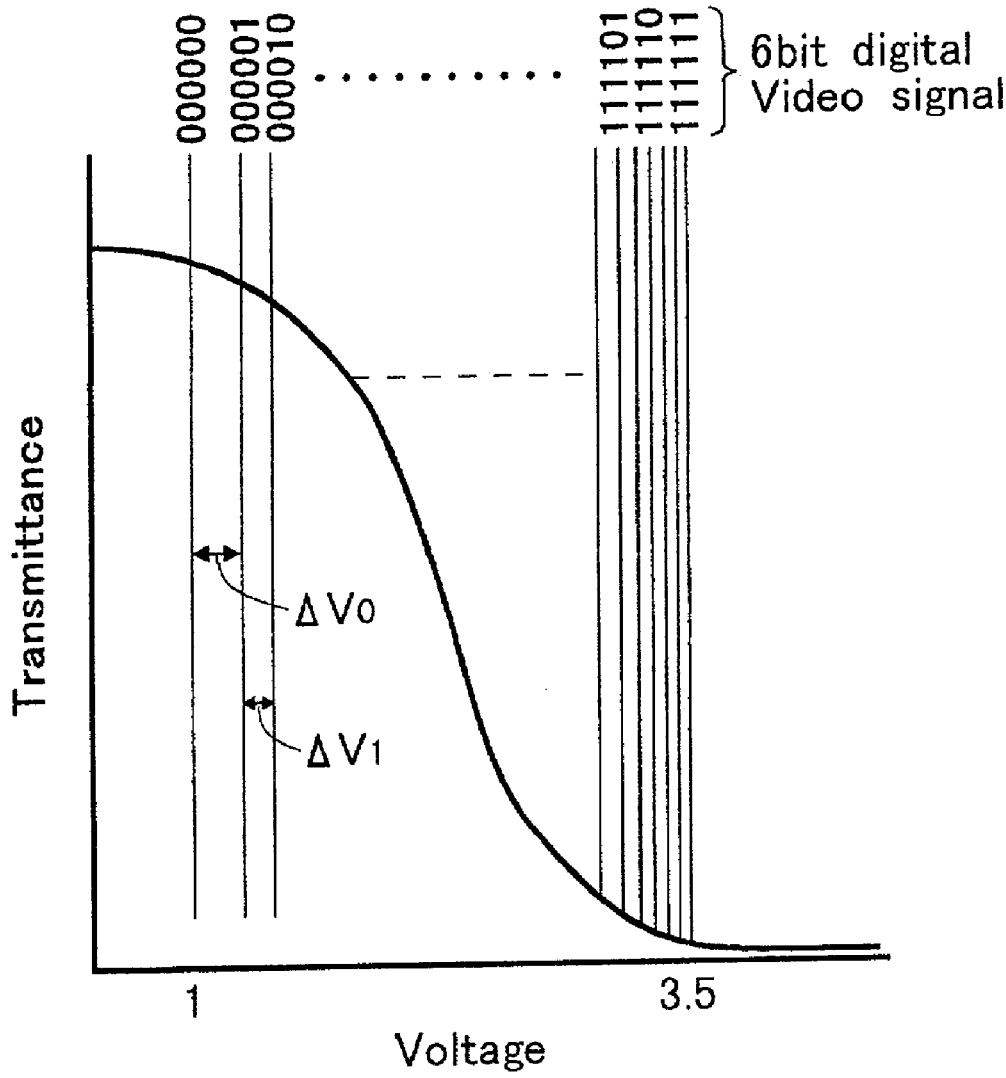
FIG. 5 shows voltage-transmittance characteristics of the liquid crystal display device of the first embodiment of this invention.

FIG. 5 shows the applied voltage—the transmittance characteristics of a liquid crystal display device. The X-axis shows the liquid crystal voltage VLC (the voltage applied to between the pixel element electrode 19 and the common electrode 32), and the Y-axis shows the relative transmittance. The digital image signal is 6-bit. As seen from the figure, in the case of the normally white display device, the relative transmittance decreases as the liquid crystal voltage VLC increases. Here, the liquid crystal voltage VLC=1V corresponds to the white display, and the liquid crystal voltage VLC=3.5V corresponds to the black display. The voltages ΔV0, ΔV1, - - - , corresponding to the 6-bit digital image signal (n5, n4, n3, n2, n1, n0) are generated and the transmittance of the liquid crystal 21 is changed according to the voltages ΔV0, ΔV1, - - - , making the gradation in the display. However, the range of the voltage ΔV decreases as the value of the digital image signal increases. That is, even if the value of the digital image signal changes, the changing in the transmittance is less pronounced. This is especially noticeable at the transmittance-saturation region of the black side. Therefore, the display panel looks blackish as a whole. In the case of the normally black display device, on the other hand, the display panel looks whitish as a whole at the white side of the gradation spectrum.

Figure 6:
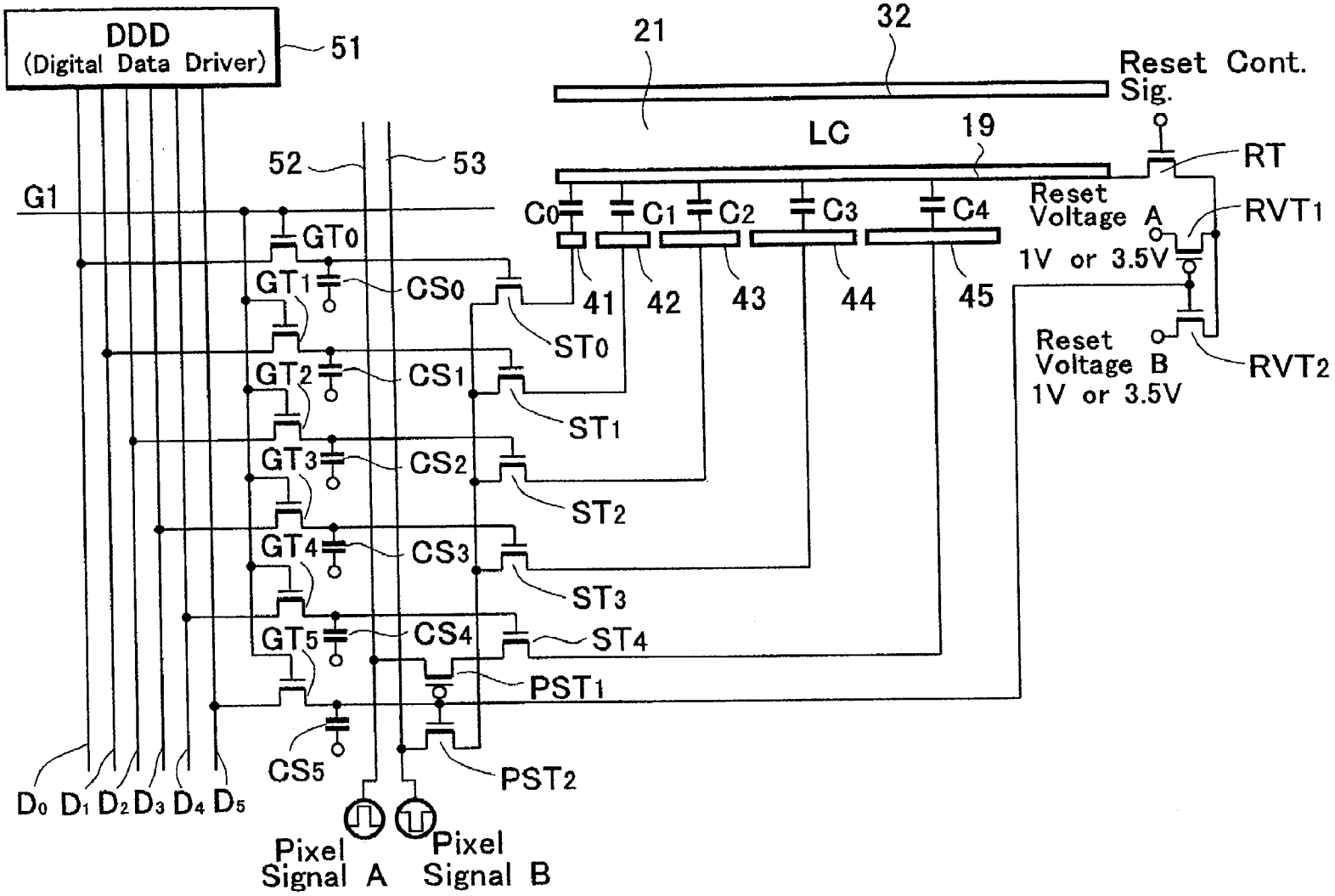
FIG. 6 is a circuit diagram of a liquid crystal display device of a third embodiment of this invention.

Therefore, this embodiment is directed to the prevention of the deterioration of the γ characteristics, leading to the better gradation in the display. FIG. 6 shows the circuit diagram of the display device of the third embodiment of this invention. In the figure, only one pixel element portion is shown for the sake of simplicity. However, in an actual display device, a plurality of pixel element portions are preferably disposed in a matrix configuration.

The scanning signal is applied to the gate signal line G1 from the gate driver (not shown in the figure). Six drain signal lines D0–D5 are disposed in the direction perpendicular to the gate signal line G1. A digital data driver circuit 51 outputs a 6-bit digital image signal in response to the sampling signal. The signal (n5, n4, n3, n2, n1, n0) corresponding to each of the bits of the digital image signal is outputted to the drain signal lines D0–D5. The lowest level bit signal n0 is outputted to the drain signal line D0, and the highest level bit signal n5 to the drain signal line D5, respectively. When the highest level bit signal n5 is "0", the other 5 lower bit signal (n4, n3, n2, n1, n0) is outputted without conversion, but when the highest level bit signal n5 is "1", the other 5 lower bit signal (n4, n3, n2, n1, n0) is outputted after they are inverted. Each of the pixel element transistors GT1–GT5 is connected to each of the drain signal 1 lines D0–D5. Also, each gate of the pixel element transistors GT0–GT5 is commonly connected with the gate signal line G1, and each source of the pixel element transistors GT0–GT5 is connected to each of the capacitance elements CS0–CS5, respectively, each of which holds each bit signal of the digital image signal written in through the pixel element transistors GT0–GT5.

Each of the bit signal retained in the capacitance elements CS0–CS5 is then supplied to the gate of the clock supplier transistors ST0–ST4. The pixel signals A and B, which are cyclical clock signals, are supplied from a clock signal selection portion to the source of the clock supplier transistors ST0–ST4.

The clock signal selection portion comprises a first clock signal selection transistor PST1 and a second clock signal selection transistor PST2. The signal n5 with the highest level bit of the digital image signal is applied to the gate and the pixel signal A is applied to the drain of the first clock signal selection transistor PST1. Likewise, the signal n5 with the highest level bit of the digital image signal is applied to the gate and the pixel signal B is applied to the drain of the second clock signal selection transistor PST2. The pixel signals A and B are, for example, clock signals in opposite phase to each other. Also, the first clock signal selection transistor PST1 comprises, for example, a P channel TFT and the second clock signal selection transistor PST2 comprises an N channel TFT.

With the configuration described above, when the signal n5 with the highest level bit of the digital image signal is "0", the pixel signal A is selected and supplied to the clock supplier transistors ST0–ST4. On the other hand, when the signal n5 with the highest level bit of the digital image signal is "1", the pixel signal B is selected and supplied to the clock supplier transistors ST0–ST4.

Also, the drains of the clock supplier transistors ST0–ST4 are connected to the capacitance electrodes 41, 42, 43, 44, and 45, which form capacitance coupling with the pixel element electrode 19. The capacitance elements C0, C1, C2, C3, and C4 are formed between the pixel element electrode 19 and the capacitance electrodes 41, 42, 43, 44, and 45, respectively. The liquid crystal 21 is enclosed between the pixel element electrode 19 and the common electrode 32.

A reset signal supplying portion, which selectively supplies reset signals A and B for resetting the voltage of the pixel element electrode 19, is provided. The reset signal supplying portion comprises a reset transistor RT, which turns on and off according to the reset control signal, a first reset signal selection transistor RVT1 and a second reset signal transistor RVT2, which selectively supply the reset signals A and B to the reset transistor.

The highest level bit of the digital image signal, n5, is applied to the gate and the reset signal A is applied to the drain of the first reset signal selection transistor RVT1. Likewise, the highest level bit of the digital image signal, n5, is applied to the gate and the reset signal B is applied to the drain of the second reset signal selection transistor RVT2. The first reset signal selection transistor RVT1 is a P channel TFT and the second reset signal selection transistor PST2 is an N channel TFT.

With the configuration described above, when the highest level bit of the digital image signal, n5, is "0", the reset signal A is selected and supplied to the pixel element electrode 19. On the other hand, when the highest level bit of the digital image signal, n5, is "1", the reset signal B is selected and supplied to the pixel element electrode 19.

Figure 7:
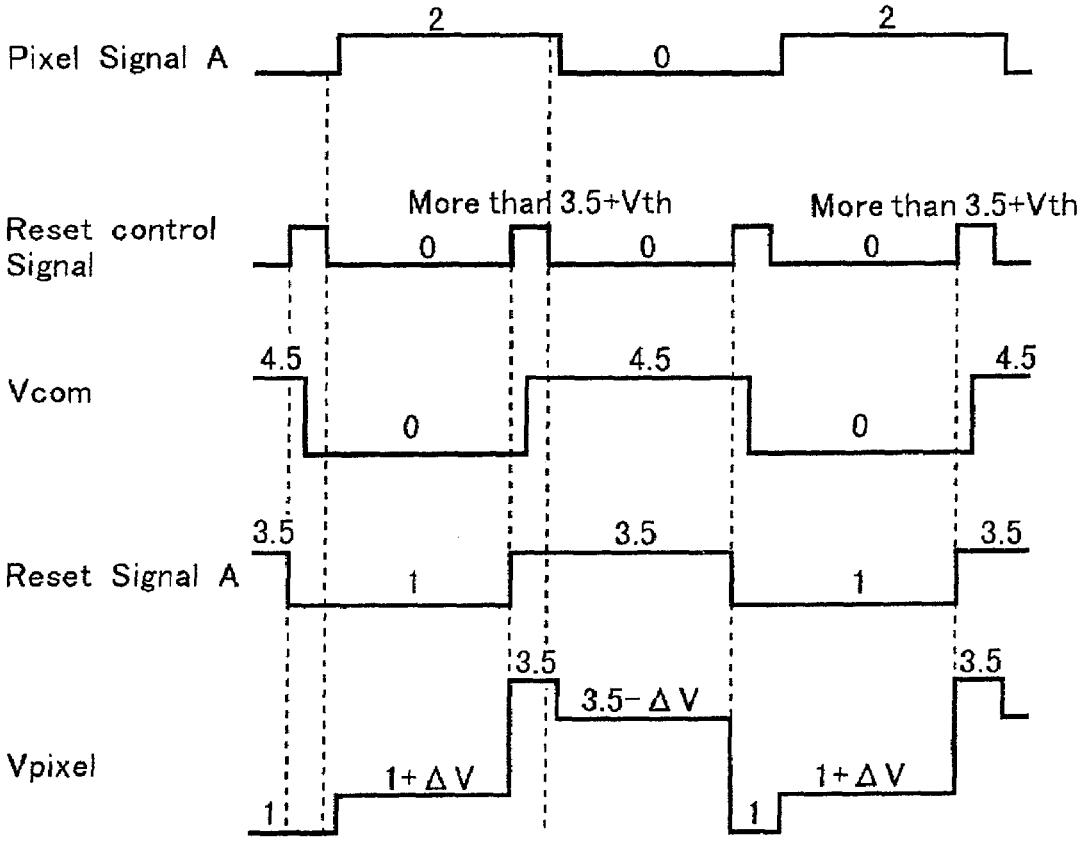
FIG. 7 is a timing chart of the liquid crystal display device of the third embodiment of this invention.
Figure 8:
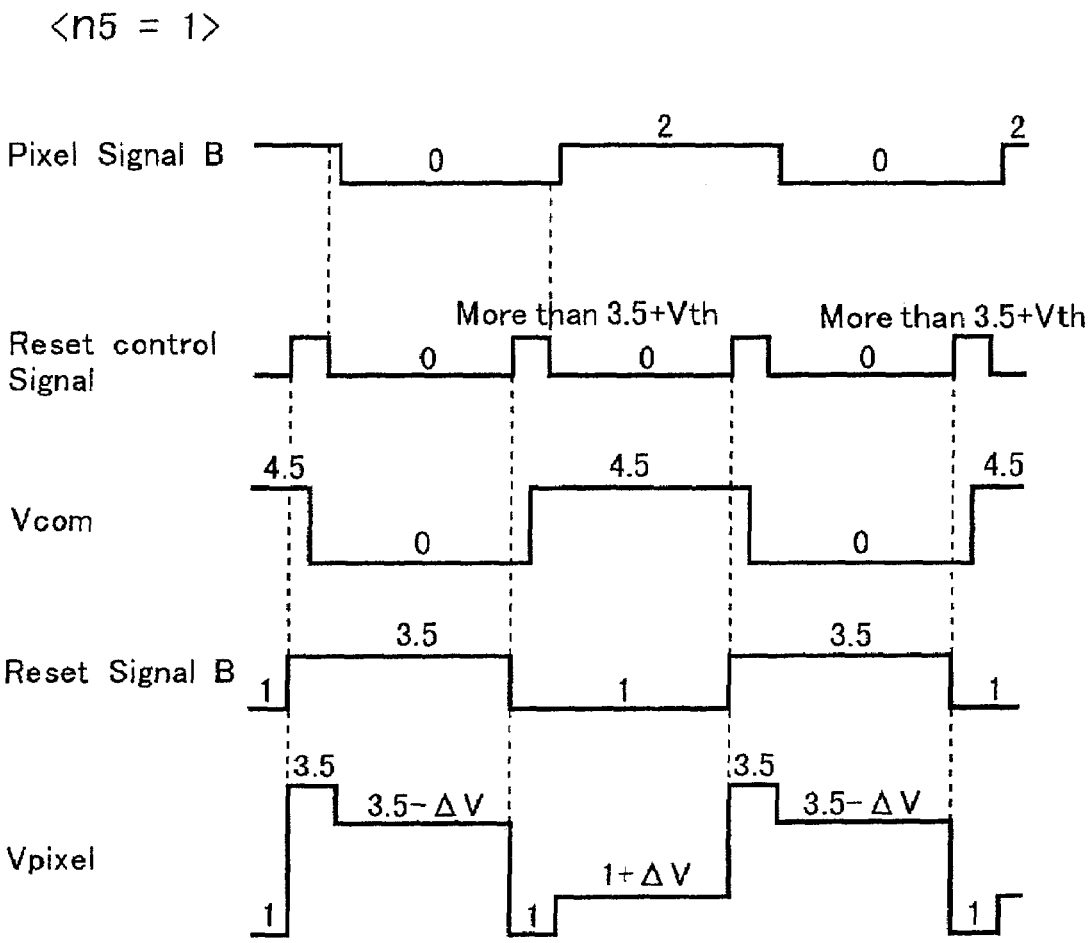
FIG. 8 is another timing chart of the liquid crystal display device of the third embodiment of this invention.
Figure 9A:
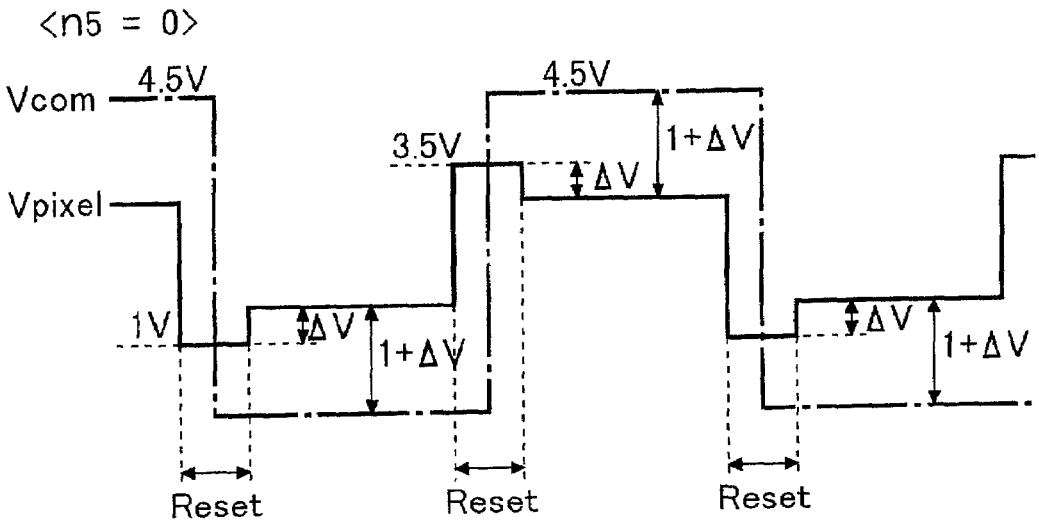
FIG. 9 is another timing chart of the liquid crystal display device of the third embodiment of this invention.
Figure 9B:
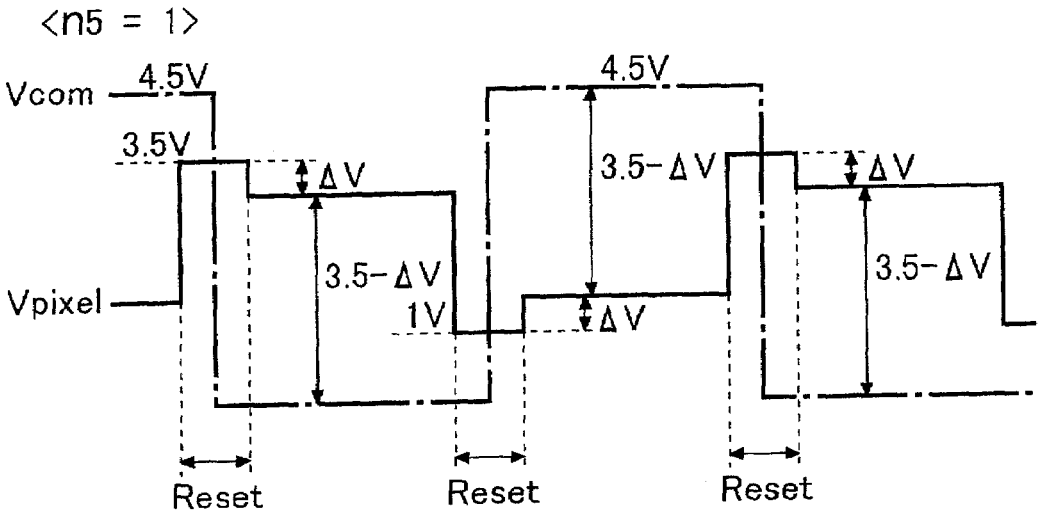

Next, the operation of the liquid crystal display device with the above configuration will be explained by referring to FIGS. 7–9. FIG. 7 is the timing chart when the highest level bit of the digital image signal, n5, is "0", and FIG. 8 is the timing chart when the highest level bit of the digital image signal, n5, is "1". FIG. 9 is the detailed timing chart showing the relationship of the voltage change between the common electrode and the pixel element electrode. The voltage of common electrode 32 is repeatedly inverted between 0V and 4.5V. When the highest level bit of the digital image signal, n5, is "0", the pixel signal A and the reset signal A are selected. Therefore, as seen from FIG. 7 and FIG. 9(A), the voltage ΔV is generated in response to the digital image signal (0,n4, n3, n2, n1, n0) with 1V, which is a white level, as a standard. Thus, the liquid crystal voltage VLC will be 1+ΔV. This is the difference in the voltage between the common electrode 32 and the pixel element electrode 19. As in the first embodiment, as the digital image signal (0, n4, n3, n2, n1, n0) increases, the range of the voltage ΔV decreases.

When the highest level bit of the digital image signal, n5, is "1", the pixel signal B and the reset signal B are selected. The pixel signal B has the opposite phase from the pixel signal A and the reset signal B has the opposite phase from the reset signal B. Therefore, as seen from FIG. 8 and FIG. 9(B), the voltage ΔV is generated in response to the digital image signal (1,n4, n3, n2, n1, n0) with 3.5V, which is a black level, as a standard. Thus, the liquid crystal voltage VLC will be 3.5−ΔV. That is, the range of the voltage ΔV is relatively large at the black level side, and the range is smaller towards the middle of the gradation. However, it is necessary to invert the 5 bits at the lower levels of the digital image signal (1,n4, n3, n2, n1, n0). For example, the signal (1, 1, 1, 1, 1, 1) corresponding to the black level is inverted to the signal (1, 0, 0, 0, 0, 0), and the signal (1, 1, 1, 1, 1, 0) is inverted to the signal (1, 0, 0, 0, 0, 1). Therefore, the changes of the voltage ΔV in the white level and in the black level must be symmetrical with respect to the center of the symmetry at the middle level.

Figure 10:
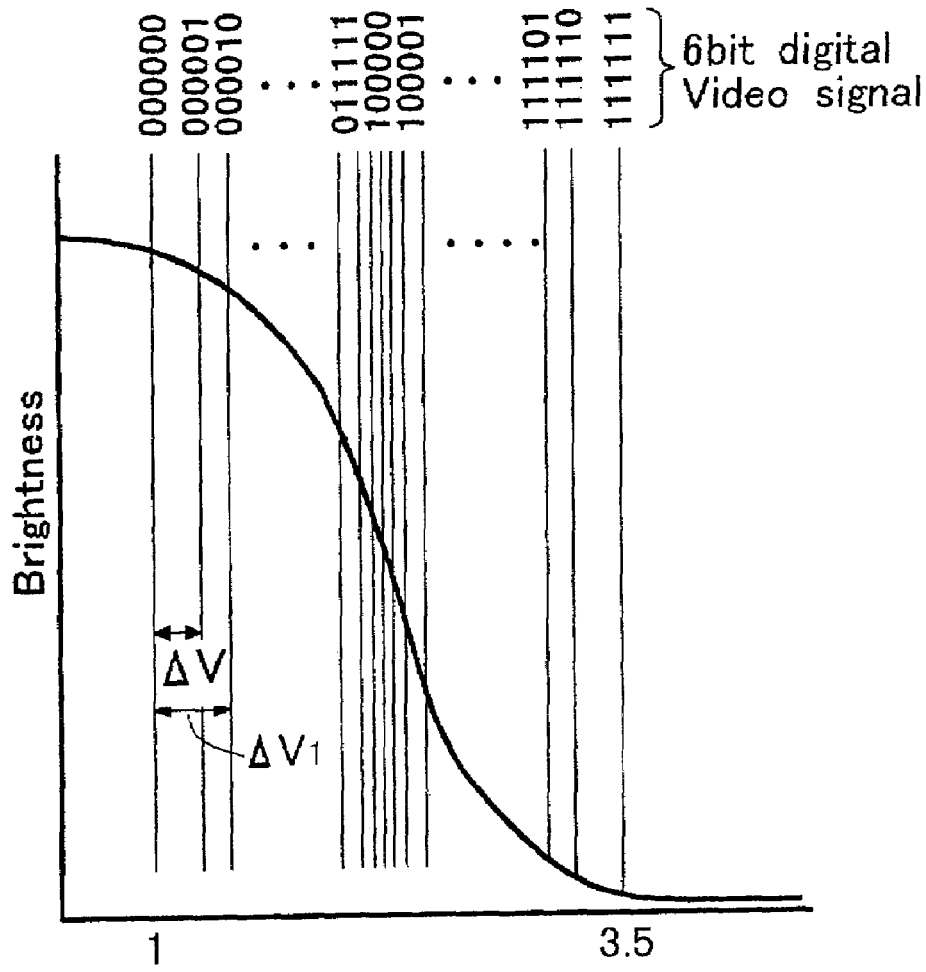
FIG. 10 shows the voltage-transmittance characteristics of the liquid crystal display device of the third embodiment of this invention.

FIG. 10 shows the applied voltage—the transmittance characteristics of the liquid crystal display device of this embodiment. The X-axis shows the liquid crystal voltage VLC (the voltage applied between the common electrode 32 and the pixel element electrode 19), and the Y-axis shows the relative transmittance. As seen from the figure, the range of the voltage ΔV is relatively large at both the black and white sides, but it is relatively small in the middle of the gradation spectrum. Therefore, the ideal γ characteristics can be achieved, leading to better gradation in the display.

Next, an application of this invention to a reflective type liquid crystal display device will be explained. The device configuration of the reflective type liquid crystal display device will be explained hereinafter by referring to FIG. 11.

Figure 11:
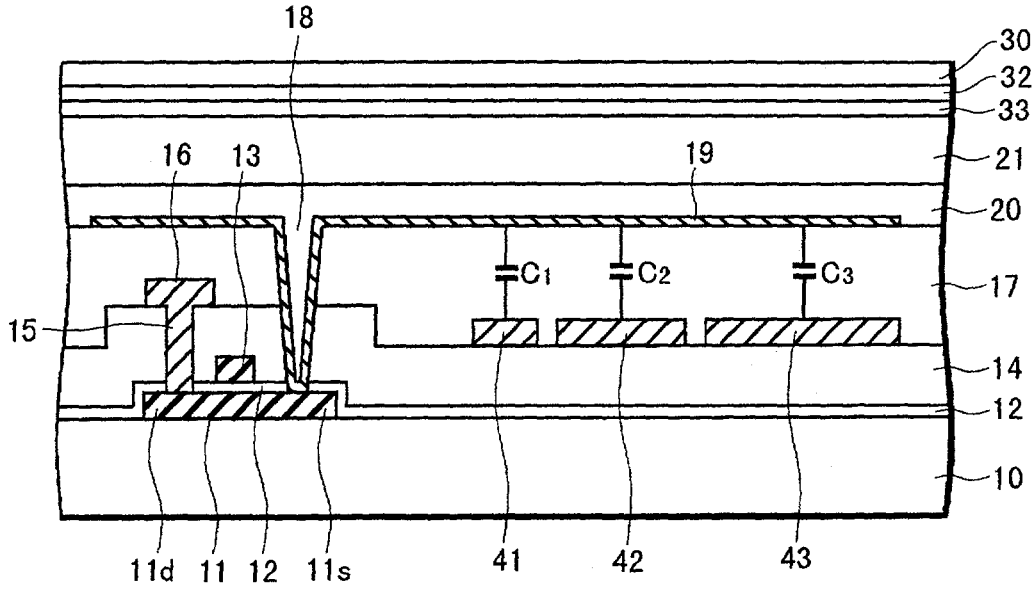
FIG. 11 is a cross-sectional view of a device configuration of a reflective-type liquid crystal display devices of the first, second and third embodiments.

As shown in the FIG. 11, on one side of the insulating substrate, a semiconductor layer 11, which is made from poly-crystalline silicon, and which is isolated, is formed. On the semiconductor layer 11, a gate insulating film 12 is disposed. Above the semiconductor layer 11, a gate electrode 13 is formed with the gate insulating film 12 between the two. In the semiconductor layer 11, a source 11*s* and a drain 11*d* are formed at the both sides of the gate electrode 13. The thin film transistor with this type of configuration can be used as the pixel element selection transistors GT0–GT3 and the reset transistor RT. This figure corresponds to the configuration of the reset transistor RT.

An inter-layer insulating film 14 is disposed on the gate electrode 13 and the gate insulating film 12. A contact hole 15 is formed at the location corresponding to the drain 11*d* in the inter-layer insulating film 14. Through this contact hole 15, the drain 11*d* is connected to a drain electrode 16. Also, at the location corresponding to the source 11*s*, a contact hole 18 is formed through the inter-layer insulating film 14 and a flattening insulating film 17. Through this contact hole 18, the source 11*s* is connected to the pixel element electrode 19. Also, away from the thin film transistor, the capacitance electrodes 41, 42, 43 made from aluminum (Al) are formed on the inter-layer insulating film 14. By forming a capacitance coupling between the capacitance electrodes and the pixel element electrode located above, the capacitance elements C1, C2, C3 are formed.

Each of the pixel element electrodes formed on the flattening insulating film 17 is made from some reflecting type material such as aluminum (Al). On each of the pixel element electrodes 19 and the flattening insulating film 17, an aligning film 20, which aligns the liquid crystal 21 and is made from polyimide, is also formed.

On the other side of the insulating substrate 30, color filters, each of which has red (R), green (G), and blue (B), the common electrode 32, which is made from transparent conductive film such as ITO (Indium Tin Oxide), and the aligning film 33, which aligns the liquid crystal 21, are formed. The color filter is necessary only for a color display.

A pair of the insulating substrates 10, 30, formed in this manner, is enclosed together at their peripheral area with an adhesive sealing material. In the space between these insulating substrates, the liquid crystal 21 is filled, completing the reflective type liquid crystal display device.

Figure 12:
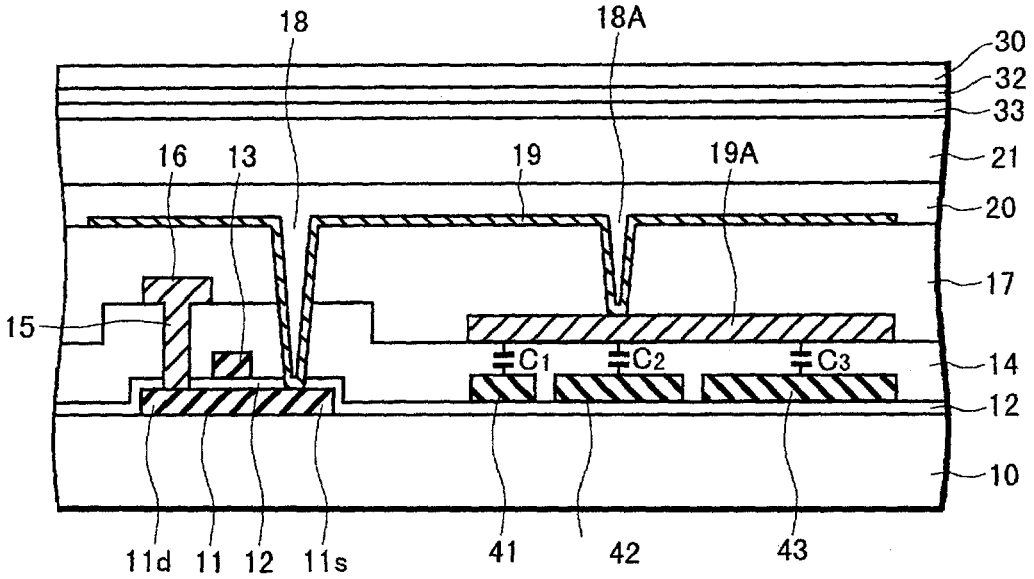
FIG. 12 is another cross-sectional view of a device configuration of a reflective-type liquid crystal display device of the first, second and third embodiments.

FIG. 12 shows a configuration of another reflective type liquid crystal display device. In this configuration, the pixel element electrode 19 is connected to the electrode 19A formed on the inter-layer insulating film 14 through the contact hole 18A formed under the flattening insulating film 17. Then, the capacitance electrodes 41, 42, 43 are formed on the gate insulating film 12. Therefore, the capacitance electrodes 41, 42, and 43 form capacitance coupling with the pixel element electrode 19 through the electrode 19A.

Figure 13:
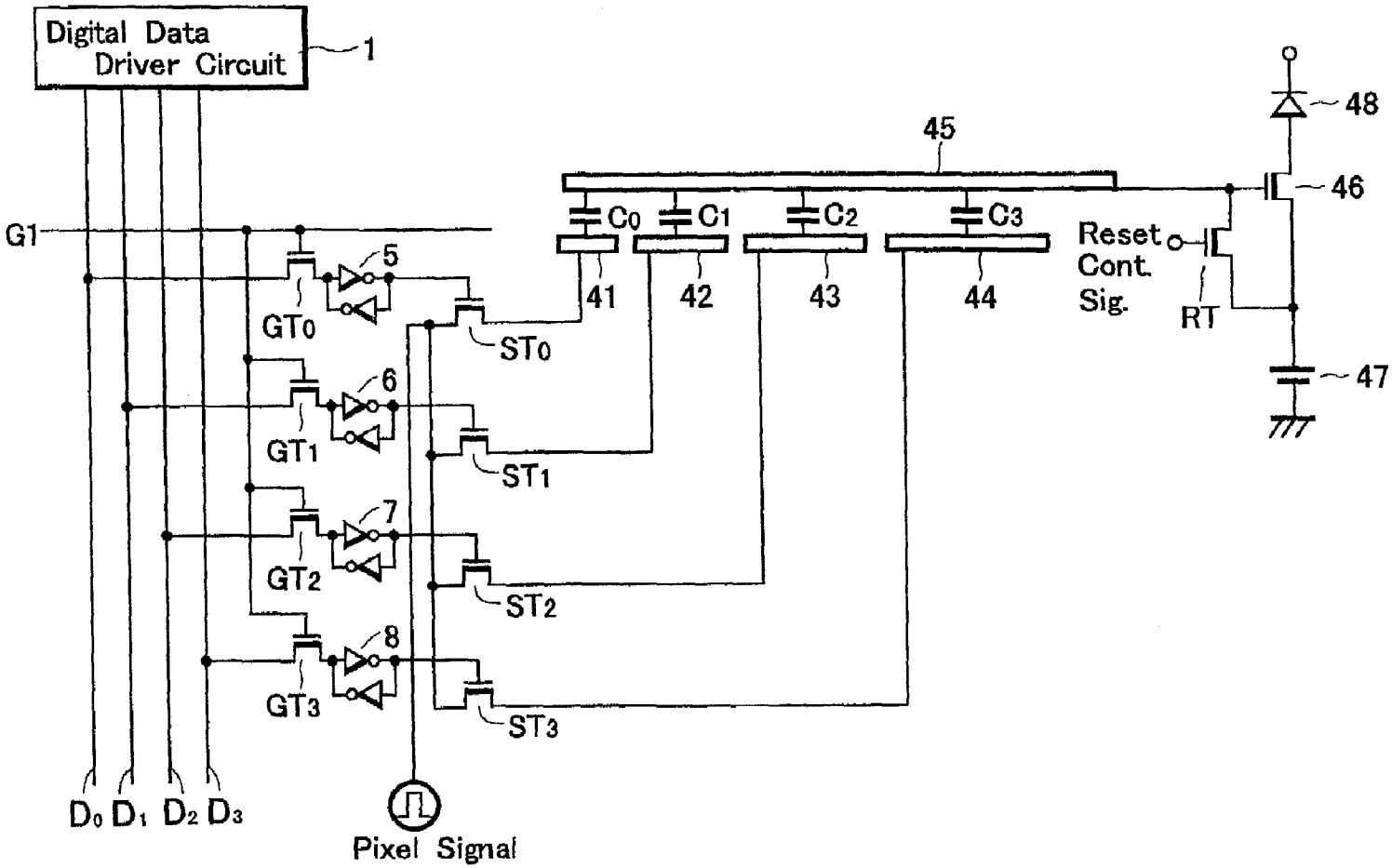
FIG. 13 is a circuit diagram of a electro-luminescence display device of a fourth embodiment of this invention.
Figure 14:
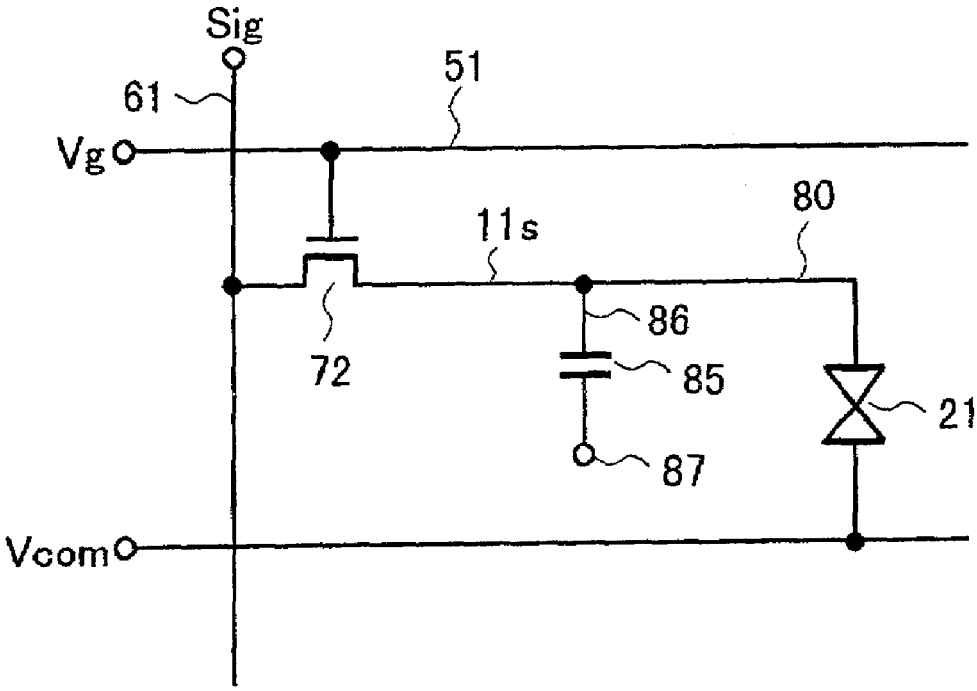
FIG.14 PRIOR ART
FIG. 14 is a circuit diagram of a conventional liquid crystal display devices.

FIG. 13 is a circuit diagram of a display device of a forth embodiment. In the figure, only one pixel element portion is shown for the sake of simplicity. However, in an actual display device, a plurality of pixel element portions are preferably disposed in a matrix configuration. Also, for the same parts as in the first embodiment of FIG. 1, the same reference numerals will be used, and the explanation will be omitted.

This embodiment is an example where this invention is applied to an electro luminescence display device. A floating electrode 45 formed in each of the pixel element forms capacitance couplings with a plurality of capacitance electrodes 41–44 and the voltage of the floating electrode 45 changes accordingly, which is the same as the first and second embodiments. Furthermore, an EL drive transistor 46, a stable electric current source 47, and an EL element 48 are formed. The EL element 48 is a light emitting element, which emits light with the luminance corresponding to the amount of the electric current applied to the element. In this configuration, the floating electrode 45 is connected to the gate of the EL drive transistor 46. The threshold voltage of the EL drive transistor is set so that the conductivity changes according to the voltage of the floating electrode 45. Thus, the electric current corresponding to the voltage of the floating electrode 45 is applied from the stable electric current source 47 to the EL element 48, making the EL element 48 emit light with corresponding luminance. This invention can be applied to another electric current drive display device by replacing EL element by other light emitting element such as an LED.

Since the DA converter, which converts the digital image signal to the analog image signal, is disposed for the pixel element portion in this invention, the circuit design in the peripheral area of the pixel element portion can be simplified, reducing the framing area of the display panel.

Also, since the digital image signal is supplied to the pixel element portion through the pixel element transistor, the voltage and the power consumption of the display device can be reduced.

The above is a detailed description of particular embodiments of the invention which is not intended to limit the invention to the embodiment described. It is recognized that modifications within the scope of the invention will occur to a person skilled in the art. Such modifications and equivalents of the invention are intended for inclusion within the scope of this invention.

What is claimed is:

1. A display device comprising:

a pixel element portion;

a drain signal line disposed on the pixel element portion;

a pixel element electrode receiving an analog image signal, the pixel element electrode being disposed in the pixel element portion; and a DA converter converting a digital image signal to the analog image signal, the DA converter being disposed in the pixel element portion and connected between the drain signal line and the pixel element electrode, wherein the DA converter comprises a plurality of capacitance electrodes and a clock supplier portion, the capacitance electrodes each forming a capacitance coupling with the pixel element electrode based on respective predetermined weighted capacitance ratios, the clock supplier portion supplying a cyclical clock signal to the capacitance electrodes in response to the digital image signal.

2. The display device of claim 1, wherein the capacitance electrodes each correspond to respective bit levels of the digital image signal, and surface areas of the capacitance electrodes are determined according to the respective bit levels.

3. A display device comprising:

a gate signal line;

a pixel element portion;

a plurality of pixel element selection transistors each selecting the pixel element portion in response to a scanning signal inputted from the gate signal line;

a drain signal line receiving a digital image signal;

a data retaining portion retaining the digital image signal inputted through the pixel element selection transistors;

a pixel element electrode;

a plurality of capacitance electrodes each forming a capacitance coupling with the pixel element electrode based on respective predetermined weighted capacitance ratios; and a clock supplier portion for supplying a cyclical clock signal to the capacitance electrodes in response to the digital image signal retained in the data retaining portion;

wherein the selection transistors, the data retaining portion, the pixel element electrode, the capacitance electrodes and the clock supplier portion are disposed in the pixel element portion.

4. The display device of claim 3, wherein the capacitance electrodes each correspond to respective bit levels of the digital image signal, and surface areas of the capacitance electrodes are determined according to the respective bit levels.

5. The display device of claim 3 or 4, wherein the data retaining portion comprises a plurality of capacitance elements for retaining the digital image signal.

6. The display device of claim 3 or 4, wherein the data retaining portion comprises a plurality of static memory circuits.

7. A display device comprising:

a plurality of pixel elements; and a plurality of pixel element electrodes disposed in the respective pixel elements, each of the pixel element electrodes facing a plurality of a capacitance electrodes electrically insulated from the pixel element electrode and each forming capacitance coupling with a corresponding pixel element electrode based on respective predetermined capacitance ratios;

wherein a voltage applied to each pixel element electrode is changed by applying a voltage corresponding to a digital image signal to each of the capacitance electrodes of the corresponding pixel element electrode.

8. The display device of claim 7, wherein the capacitance electrodes each correspond to respective bit levels of the digital image signal.

9. The display device of claim 7 or 8, further comprising a plurality of data retaining portions retaining the digital image signal, the data retaining portions being disposed for the respective pixel elements, each of the data retaining portions retaining voltages each corresponding to respective bits of the digital image signal.

10. A display device comprising;

a plurality of pixel elements;

a plurality of pixel element electrodes disposed in the respective pixel elements, each of the pixel element electrodes facing a plurality of capacitance electrodes electrically insulated from the pixel element electrode and each forming a capacitance coupling with the pixel element electrode based on respective predetermined weighted capacitance ratios;

a plurality of clock supplier portions supplying a cyclic clock signal in response to a digital image signal to the capacitance electrodes,the clock supplier portions being disposed in corresponding pixel elements;

a plurality of clock signal selection portions selecting the clock signal according to a voltage corresponding to the highest bit of the digital image signal, the clock signal selection portions being disposed in the corresponding pixel elements; and a plurality of reset signal supplier portions selecting a reset signal and supplying the reset signal to the corresponding pixel element electrodes according to a voltage corresponding to the highest bit of the digital image signal, the reset signal supplier portions being disposed in the corresponding pixel elements.

11. The display device of claim 10, wherein the clock signal comprises a first clock signal and a second clock signal, a phase of the first clock signal being opposite to a phase of the second clock signal.

12. The display device of claim 11, wherein the clock signal selection portion comprises a first clock signal selection transistor receiving the voltage of the highest bit at a gate thereof and the first clock signal at a drain thereof and a second clock signal selection transistor receiving the voltage of the highest bit at a gate thereof and the second clock signal at a drain thereof.

13. The display device of claim 10, wherein the reset signal comprises a first reset signal and a second reset signal, a phase of the first clock signal being opposite to a phase of the second clock signal.

14. The display device of claim 13, wherein the reset signal supplying portion comprises a first reset signal selection transistor receiving the voltage of the highest bit at a gate thereof and the first reset signal at a drain thereof and a second reset signal selection transistor receiving the voltage of the highest bit at a gate thereof and the second reset signal at a drain thereof.

* * * * *